United States Patent [19]

Deutsch et al.

[11] 4,342,248

[45] Aug. 3, 1982

[54] ORCHESTRA CHORUS IN AN ELECTRONIC MUSICAL INSTRUMENT

[75] Inventors: Ralph Deutsch, Sherman Oaks; Leslie J. Deutsch, Glendale, both of Calif.

[73] Assignee: Kawai Musical Instrument Mfg. Co., Ltd., Hamamatsu, Japan

[21] Appl. No.: 218,884

[22] Filed: Dec. 22, 1980

[51] Int. Cl.[3] ..... G10H 1/02; G10H 1/22

[52] U.S. Cl. ..... 84/1.24; 84/1.19; 84/1.25; 84/DIG. 2; 84/DIG. 4

[58] Field of Search ..... 84/1.01, 1.03, 1.11, 84/1.12, 1.19–1.21, 1.24, 1.25, DIG. 2, DIG. 4

[56] References Cited

U.S. PATENT DOCUMENTS 3,757,022 9/1973 Markowitz ..... 84/1.25

3,978,755 9/1976 Woron ..... 84/1.24

*Primary Examiner*—Stanley J. Witkowski

*Attorney, Agent, or Firm*—Ralph Deutsch

[57] ABSTRACT

A keyboard operated electronic musical instrument in which a number of tone generators are assigned to actuated keyswitches. When a keyswitch is actuated, a tone generator is assigned with a musical waveshape selected from a library of waveshapes which are ordered in a predetermined arrangement. The assignment of waveshapes is made in a priority order according to the musical frequencies associated with the actuated keyswitches so that a chorus effect is obtained in which each note of a group of simultaneous notes has its own tone color. The assignment of waveshapes is made in an adaptive manner so that the melody line retains its own distinctive sound even when the number of notes played simultaneously on a keyboard changes. Vibrato effects can selectively be applied to any of the set of waveshapes.

11 Claims, 3 Drawing Figures

ORCHESTRA CHORUS IN AN ELECTRONIC MUSICAL INSTRUMENT

BACKGROUND OF THE INVENTION

1. Field of the Invention

This invention relates to keyboard operated electronic musical instruments and in particular is concerned with a provision for automatically assigning different tones to each of a number of notes played simultaneously on a single keyboard.

2. Description of the Prior Art

The current trend in the design of electronic keyboard operated musical instruments is to use these instruments to imitate a small ensemble of individual musicians such as a small orchestra or combo. Electronic organs have been used in this fashion because their multiple keyboards lend themselves to a simultaneous blend of different musical tone colors. Each keyboard can be programmed by means of stop switches to produce its own distinctive sound. With the arrangement of multiple keyboards and stop switches, the musician can create a wide variety of solo and accompaniment effects. It is indicative of the desired musical design that the common names used to designate the keyboards suggests their use as a small orchestra. The upper keyboard is called the solo manual (keyboard), the lower keyboard is called the accompaniment manual (keyboard) and the third keyboard operated by the feet is called the pedal keyboard.

A limitation in the use of multiple keyboards to imitate a small orchestra is that usually a single tone color is mandated for all the notes played on a single keyboard as determined by the actuated stop switches. This is contrary to the musically desirable mode of separately assigning tone colors to the solo tone and each harmony tone to obtain a musical effect corresponding to orchestral music.

In U.S. Pat. No. 4,149,441 entitled "Electrical Musical Instrument" a system is described which is intended to imitate a small orchestra. When a single note, for example, is played on a keyboard a system of logic causes a selection from a harmonic pattern of accompaniment notes to be played. A feature is that the automatically selected accompaniment notes are treated individually to produce their own tonal color as distinct from that assigned to the actuated note.

It is an object of this invention to provide means for automatically assigning different preselected tone colors to each of a number of notes played on a single keyboard.

It is a further object of this invention to assign the tone colors in a manner that maintains the solo line tone color as the number of actuated keys on a keyboard changes with time.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. During the computation cycle a number of master data sets are created by implementing a discrete Fourier algorithm using stored sets of harmonic coefficients which characterize preselected musical tones. The computations are carried out at a fast rate which may be nonsynchronous with any musical frequency. Preferably the harmonic coefficients and the orthogonal functions required by the Fourier algorithm are stored in digital form and the computations are carried out digitally. At the end of a computational cycle the master data sets are stored in separate main registers.

Following a computation cycle, a transfer cycle is initiated during which the master data sets are transferred in a prescribed manner to preselected members of a multiplicity of tone generators. The output tone generation continues uninterrupted during the computation and transfer cycles.

The present invention is directed toward the assignment of the multiplicity of master data sets to tone generators in such a manner that the tonal selection is maintained in a desirable fashion between the solo melodic musical lines and the associated harmonic accompaniment musical lines on the same keyboard. The highest frequency note is assigned a given master data set, or tone color, and each lower frequency actuated note is also assigned its own master data set. New assignments of master data sets are made only when a new keyswitch is detected to have been actuated. The present assignments are maintained unaltered when keyswitches for other notes are released. The assigned tone colors can be selected from a variety of tones and are not restricted to be at the same musical stop footage.

BRIEF DESCRIPTION OF THE DRAWINGS

For a better understanding of the invention reference should be made to the accompanying drawings.

DETAILED DESCRIPTION OF THE INVENTION

A chorus effect, or orchestra chorus, is the generic term given to the musical effect in which a set of tones played on a single keyboard are generated with different tone colors.

The present invention is directed to an improvement in the tone generation system of a type that has the capability of simultaneously producing a multiplicity of musical waveshapes and arranged to produce a chorus effect. A tone generation system of this type is described in detail in U.S. Pat. No. 4,085,644 entitled "Polyphonic Tone Synthesizer" and which is hereby incorporated by reference. In the following description, all elements of the system which are described in the referenced patent are identified by two digit numbers which correspond to the same numbered elements used in the patent. All system element blocks which are identified by three digit numbers correspond to elements added to the Polyphonic Tone Synthesizer to implement the improvements of the present invention.

Figure 1:
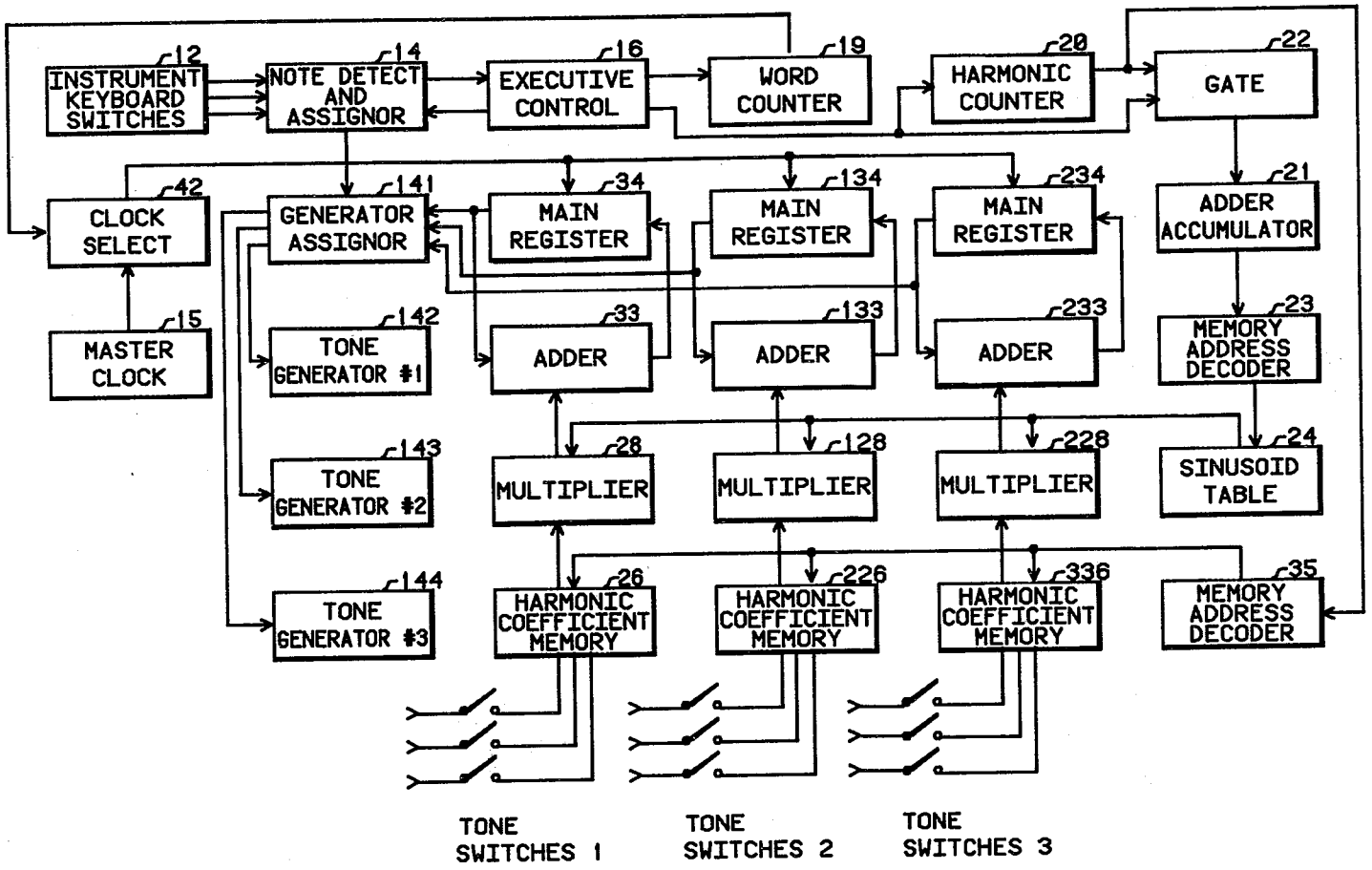
FIG. 1 is a block diagram of the tone generating system.

In FIG. 1, the collection of keyswitches for all keyboards is shown generally by the block labeled instrument keyboard switches 12. Whenever a keyswitch is actuated or released on any of the keyboards, note detect and assignor 14 detects such keyswitch state changes and stores, for each actuated switch, information corresponding to the note within an octave, the octave number for the keyboard, and a keyboard identification number. This information is stored in a memory (not shown) which is a component of the note detect and assignor 14. The operation of a suitable note detect and assignor subsystem is described in U.S. Pat. No. 4,022,098 entitled "Keyboard Switch Detect And Assignor" which is hereby incorporated by reference.

Each keyswitch has two operational states. It can be in an actuated state, a "closed" position, or it can be in an unactuated state, an "open" position. The operational states, or states, of a keyswitch are also called the keyswitch states.

The invention is described for three tone generators which are assigned to a single keyboard. It is a simple matter to extend the system to more than three tone generators which number does not represent a restriction or limitation of the present invention. The subsystems described for a single keyboard can be duplicated for any desired number of keyboards.

A computation cycle is initiated by the executive control 16. A sequence of computation cycles can be initiated when one or more keyswitches have been actuated on any of the keyboards. The start of any of the computation cycles in the sequence of computation cycles is inhibited until the completion of a transfer cycle so that the tone generation can continue uninterjupted during the repetitive sequences of computation cycle and transfer cycle.

At the start of a computation cycle, executive control 16 resets the contents of the word counter 19 and the harmonic counter 20 to an initial state. The word counter 19 is implemented to count modulo 64 corresponding to the number of equally spaced points for one period of a musical waveshape. The word counter 19 is incremented by signals furnished by the executive control 16. The count states of this counter are used to address data into and out of the set of main registers 34, 134, and 234 when this source of addressing data is selected by the clock select 42 during a computation cycle.

The harmonic counter 20 is incremented each time that the word counter 19 returns to its initial count state. The harmonic counter 20 is implemented to count modulo 32. The general rule is that the maximum number of harmonics is no greater than one-half of the number of equally spaced points defining one period of the musical waveshape.

Gate 22, in response to a signal from the executive control 16, transfers the current state of the harmonic counter 20 to the adder-accumulator 21 which adds the transferred data to the current data in its accumulator. The contents of the adder-accumulator 21 are called argument values and are used by the memory address decoder 23 to address, or access, stored trigonometric function values from the sinusoid table 24.

The trigonometric function data values addressed out from the sinusoid table 24 are furnished as one of the inputs to the set of multipliers 28, 128, and 228. The second input to these multipliers are harmonic coefficients that are read out of the associated harmonic coefficient memories 26, 226 and 326.

Each harmonic coefficient memory stores sets of harmonic coefficients corresponding to a library of musical tones. The selection of the stored harmonic coefficients is made by means of the associated tone switches. The tone switches are also called stops or stop switches. Each set of harmonic coefficients comprises a set of 32 data words corresponding to the maximum count state of the harmonic counter 20. The memory address decoder 35 addresses out the harmonic coefficients from the harmonic coefficient memories in response to the count states of the harmonic counter 20.

The output from each of the multipliers 28, 128 and 228 is added to data addressed out from their associated main registers and the sum is stored in these registers. In this fashion at the end of a computation cycle each of the main registers 34, 134, and 234 will contain a master data set corresponding to one period of a musical waveshape determined by the actuated states of the tone switches.

During the transfer cycles the data contained in the three main registers is transferred by the generator assignor 141 to the set of three tone generators 142, 143, and 144 in a manner to be described in detail. The tone generators contain elements that are used to translate the master data set information into audible musical sounds. Each tone generator contains a note register which stores a master data set, a note clock means for reading out data from an associated note register at a rate corresponding to the musical frequency of an actuated keyboard switch, a digital-to-analog converter for converting the digital waveshape data to analog signals, and a sound system for producing audible tones from the analog signals. It is common practice to use a single sound system shared by all of the tone generators.

Figure 2:
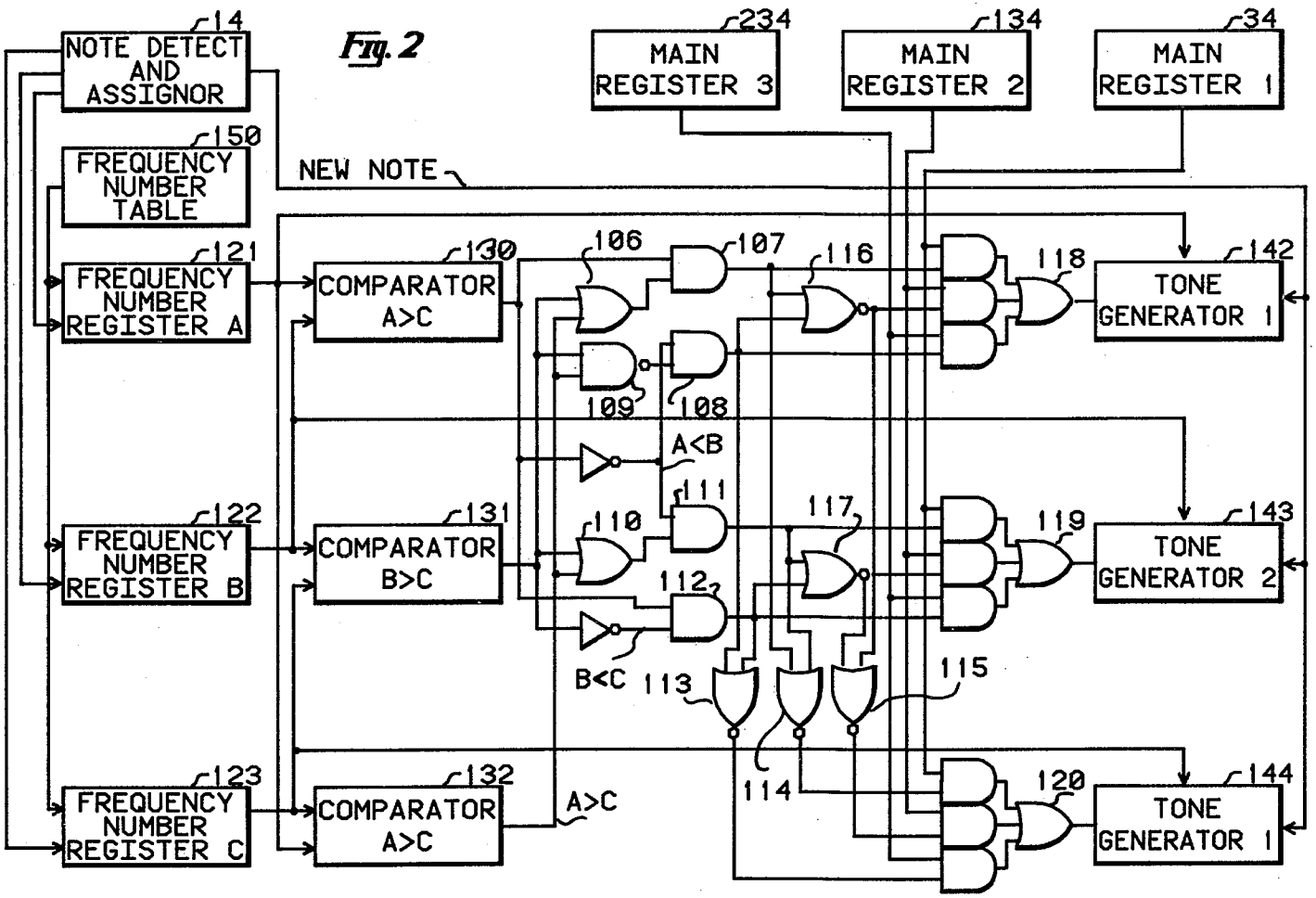
FIG. 2 is a block diagram of the tone generator assignor.

FIG. 2 shows the detailed system logic of the generator assignor 141. The assignment of the master data sets residing in the three main registers 34, 134 and 234 to the three tone generators 142, 143 and 144 is made on a decision criterion determined by the relative frequency of the actuated notes.

The decision criterion implements the entries shown in Table 1. The notation of denoting a frequency, such as $f_A$, by the letter A is used in the table and in the figures.

TABLE 1

| Frequency Comparison | | | Tone Generators | | |
|---|---|---|---|---|---|
| A > B | B > C | A > C | T1 | T2 | T3 |
| 0 | 0 | 0 | C | B | A |
| 0 | 0 | 1 | — | — | — |
| 0 | 1 | 0 | B | C | A |
| 0 | 1 | 1 | B | A | C |
| 1 | 0 | 0 | C | A | B |
| 1 | 0 | 1 | A | C | B |
| 1 | 1 | 0 | A | B | C |
| 1 | 1 | 1 | — | — | — |

The frequency entries under the three generator columns designate the selected tone that is assigned each of the frequencies. A dashed line indicates an impossible frequency ordering for a keyboard musical instrument.

To illustrate the assignment logic shown in FIG. 2 and tabulated in Table 1, assume that three notes are actuated on the keyboard controlling the three tone generators. The three frequencies are assumed to ordered as A>B>C. The assignment data stored in the note detect and assignor 14 is decoded and used to address a frequency number out of the frequency number table 150 for each actuated note. These numbers are addressed out sequentially as data is addressed out from the assignment memory. The accessed frequency numbers are stored in the frequency number registers 121, 122, and 123 under control of the note detect and assignor.

Apparatus for accessing frequency numbers from a table of frequency numbers is described in U.S. Pat. No. 4,067,254 entitled "Frequency Number Controlled Clocks." This patent is hereby incorporated by reference. The frequency numbers represent the ratio of a musical frequency to the highest musical frequency on the keyboard. The frequency numbers increase with increasing frequency.

Comparator 130 compares the frequency A stored in frequency number register 121 with the frequency number B stored in the frequency number register 122. The output state of comparator 130 will be a logic state "1" if A>B.

Comparator 131 compares the frequency number B stored in frequency number register 122 with the frequency number C stored in the frequency number register 123. The output state of comparator 130 will be a logic state "1" if B>C.

Comparator 132 compares the frequency number A with the frequency number C. The output state of comparator 132 will be a logic state "1" if A>C.

For drawing convenience and clarity, the lines containing the frequency numbers and the master data set are drawn as single lines. It is to be understood that these are symbolic of a number of lines required to transmit each of the bits in the frequency numbers and the master data set. This is a common drawing simplification used in digital logic systems when the explicit display of each individual bit lines conveys no new information to an explanation of the system operation.

For the first illustrative case of A>B>C, each of the three comparators will have a "1" logic output state. Both inputs to the AND-gate 107 are a "1" so that a "1" state is transmitted as a select signal to the select gate 118 to cause the master data set contained in the main register 1 to be available at the output from this select gate.

The other two select signals to the select gate 118 will be a logic "0". One input to the NOR-gate 116 is the "1" from AND-gate 107. This will transfer as a "0" state. Both input lines to the NAND-gate 109 are "1" so that one input to the AND-gate 108 is a "0". The "1" state from the comparator 130 is inverted to a "0" and forms the second input to the AND-gate 108. Thus the second input to the NOR-gate 116 is a "0" and the second and third select signals to the select gate 118 are both "0".

The "1" state from comparator 130 is inverted to a "0" as one input to the AND-gate 111. Thus the first select signal to select gate 119 is a "0". The "1" state from comparator 131 is inverted and applied as a "0" state to the AND-gate 112. Thus the third select signal to select gate 119 is a "0". One input to the NOR-gate 117 is the "0" state output of AND-gate 111. The second input to the NOR-gate 117 is the "0" state output from the AND-gate 112. Thus the output of NOR-gate 117 is a "1" and so the second select signal to the select gate 119 is a "1". In response to this set of select signals, the master data set contained in the main register 134 is available at the output of the select gate 119.

One input to NOR-gate 114 is the "0" state output from the AND-gate 112. The second input is the "1" state output from the AND-gate 107. Therefore the first select signal for select gate 120 generated by NOR-gate 114 is a "0". One input to NOR-gate 115 is the "0" state output of NOR-gate 116. The second input to NOR-gate 115 is the "1" state output of NOR-gate 117. Therefore the second select signal will be a "0". One input to the NOR-gate 113 is a "0" state from AND-gate 111 and the second input is a "0" state from AND-gate 112. Therefore the third select signal will be a "1" and the master data set contained in the main register 234 is available at the output of the select gate 120.

The waveshape data, in the form of master data sets, appearing at the output of the select gates is not transferred into the tone generators until a new note has been actuated on the keyboard. The note detect and assignor 14 contains logic which determines when a new keyswitch has been actuated and generates a new note signal when such a detection is made. Thus once the three tone generators have been loaded with their waveshape data, no change in the waveshapes, or tones, will occur as long as the three keyboard switches are depressed in their actuated state.

Now suppose that the top finger, or highest note, is released so that only two fingers are to be used. As long as the remaining two keyswitches remain actuated, there will be no tone change caused by the release of the top finger. However as soon as a new keyswitch is activated, the assignment generator 141 will cause the master data set in main register 34 to be assigned to the tone generator corresponding to the highest note for the actuated keyswitches while the master data set in main register 134 will be assigned to the second actuated keyswitch which corresponds to a lower note frequency. This action is detailed as follows.

Since the the highest note has been released from its keyswitch, the note detect and assignor will assign a zero value for the frequency number A which is stored in the frequency number register 121. In this case, the output logic state from comparator 130 will be a "0" state. Assume, for illustrative purposes, that the frequency number C is higher in magnitude than the magnitude of the frequency number B. For these conditions both comparators 131 and 132 will produce a "0" output logic state.

In response to a "0" state from comparator 131, one input to the AND-gate 111 will be a "0". The "0" state output from comparator 130 will be inverted to provide a "1" state to the second input to AND-gate 111. The net result is a "0" state for the output of AND-gate 111 which is one of the signal inputs to the NOR-gate 114. Because the output state of the comparator 130 is a "0", the output state of the AND-gate 107 will be "0". This state is the second input to the NOR-gate 114. Since both input states to the NOR-gate 114 are a logic "0", a logic "1" signal is generated which is the first select signal to the select gate 120. Therefore the desired condition is obtained in that the master data set stored in main register 34 will be transferred to tone generator 144 when a new note signal is generated by the note detect and assignor 14. This is the desired action for the illustrative example in which C is the highest frequency of the two actuated notes.

The output state from AND-gate 111 is a "0", as previously described, so that the first select signal to the select gate 119 is a logic "0". This "0" state is also one input to the NOR-gate 117. The "0" state output from the comparator 130 will produce a "0" state at the output of the AND-gate 112. Thus the second input to the NOR-gate 117 is also a logic "0" which produces a logic "1" state at the output of this NOR-gate. This "1" state is the second select signal to the select gate 119. Therefore when a new note signal is generated by the note detect and assignor 14, the contents of the main register 134 will be transferred to the tone generator #2, 143.

An examination of the logic states shows that the first and second select signals to the select gate 118 are in the "0" state and the third select signal is in the "1" state. Thus the contents of the main register 234 would be transferred into the tone register #3 142 when the NEW NOTE signal occurs. However, since A=0, this tone generator will not produce any audible output tones. This is a situation in which the third tone generator is not assigned because only two keyswitches are in the actuated state.

Finally, the last case to be examined is one in which only a single keyswitch is actuated. It will be assumed for illustrative purposes that the single keyswitch data will be assigned to the tone generator #2, 143. In this case, the desired condition is that the data residing in the main register 34 be transferred to the tone generator #2 143. The frequency numbers A and C will both have a zero value. Thus the comparators 130 and 132 will have a "0" output logic state while comparator 131 will have a "1" output logic state.

The output of OR-gate 110 will be a "1" state which is transferred as one of the input signals to the AND-gate 111. The "0" state output from the comparator 130 is inverted to a "1" and applied as the second input to the AND-gate 111. Thus a "1" state will occur for the first select signal to the select gate 119. Examination of the logic states shows that the second and third select signals to the select gate 119 will be in the "0" logic state. Therefore the data residing in the main register 34 will be transferred to the tone generator #2 143 when a NEW NOTE signal is generated by the note detect and assignor 14.

The remaining two tone generators are in a "don't care" condition because they are not assigned to any keyboard switch in this illustrative situation.

It is noted that the assignment of tones is always made in a frequency order with the highest frequency note always having a designated tone color, the second note if it exists always an assigned second tone color, and the third note if it exists always has an assigned third tone color. Moreover, the shift in tone colors does not occur when a keyswitch is released but only occurs when a new actuation of a keyswitch is detected. This prevents any distracting change of tone colors while keyswitches remain in their actuated states unless one or more keyswitches are newly actuated.

It is clear from the foregoing description that a wide variety of different tonal effects can be obtained by the manner in which the three master data sets are computed. For example, there is no restriction or limitation of having the set of tone generators create tones at the same musical footage. Thus a chorus containing a 16-foot, 8-foot, and 4-foot is readily obtained by means of the present invention simply by having the three tone generators operate at the three selected musical footages. This type of arrangement provides a very good musical effect. Each of the tone generators, of course, can produce its own combination of tones which may contain a selected variety of musical pitches.

A sliding formant system, such as that described in the referenced U.S. Pat. No. 4,085,644, can be used for the creation of each of the master data sets so that independent sliding formants can be used for any desired combination of the three tones.

The extension of the system to more than three tone generators is made by including additional frequency number registers, additional frequency number comparators, additional tone generators, enlarged select gates, and additional select logic similar to that shown in FIG. 2. The number of comparators is equal to the number of distinct pairs of frequency numbers. The number of frequency numbers is equal to the number of tone generators. The number of distinct pairs of N frequencies is given by the binomial coefficient N!/[(N-2)!2].

Figure 3:
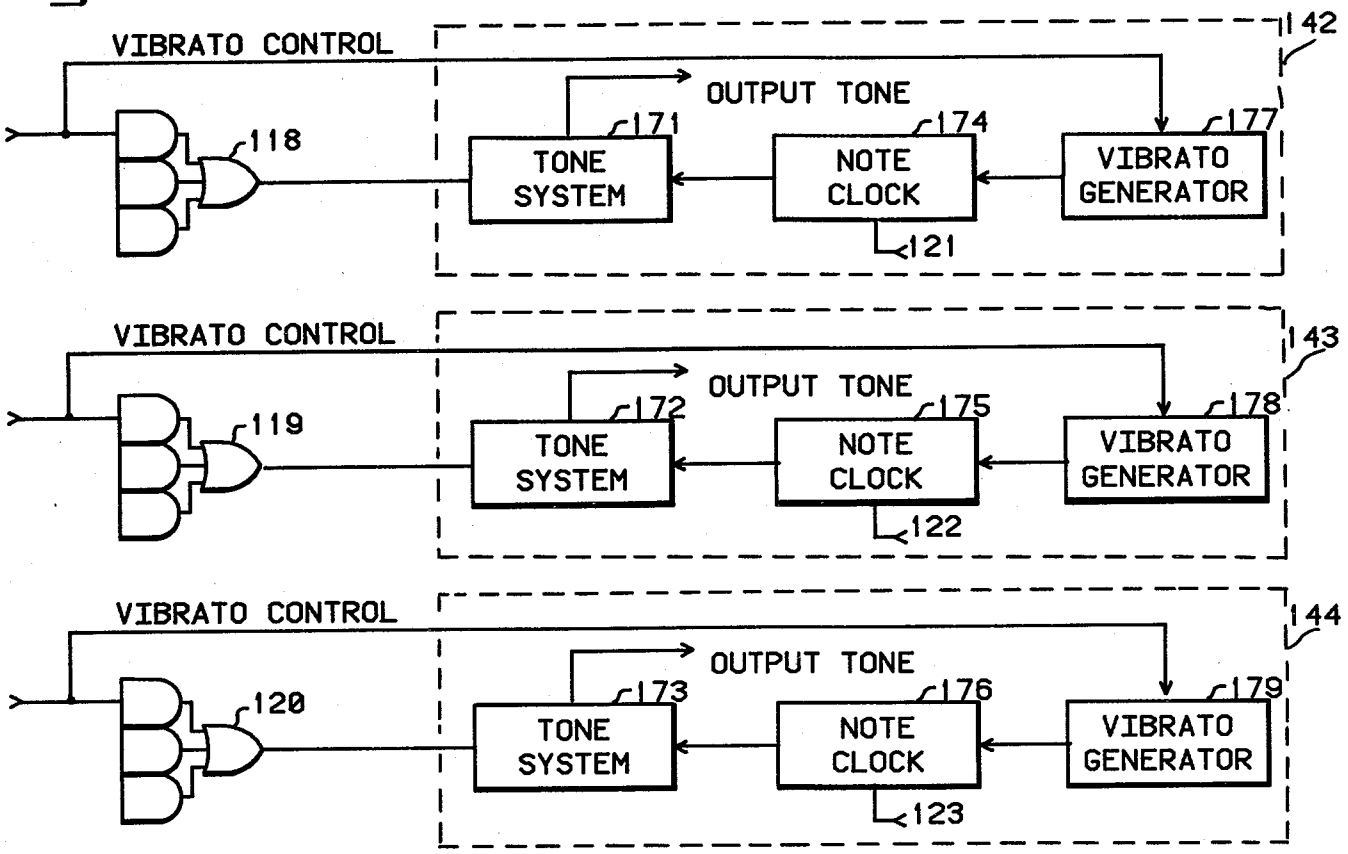
FIG. 3 is a block diagram of a selective vibrato control.

A novel musical effect can be obtained by applying vibrato only to selected generators such as the tone generator which contains data transferred from one of the main registers such as main register 34. In this fashion the top note for the melody line will be generated with vibrato while the other notes simultaneously played on the same keyboard would not have vibrato. The first select signal to each of the three select gates 118, 119, 120 can be used to actuate the vibrato generator for the corresponding tone generator. A system for implementing such a selective vibrato effect is shown in FIG. 3. A note clock and a vibrato generator is contained in each of the tone generators. For example, tone generator 1 142 contains the vibrato generator 177, a note clock 174, and a tone system 171. In response to a "3" logic state for the first select signal to the select gate 118, the vibrato generator 177 will generate a low frequency signal to frequency modulate the note clock 174. The note clock is operated at a frequency corresponding to the frequency number contained in the frequency number register A. The note clock determines the fundamental frequency of the musical tones created by the tone system 171.

The various select signals can be used to control other musical effects such as portamento and glide. In this fashion selected musical effects can be readily provided in an independent fashion for each of the set of tone generators comprising the orchestra chorus.

We claim:

1. In a musical instrument having a multiplicity of tone generators which are assigned to actuated keyswitches contained in a keyboard array of keyswitches, having keyswitches each operable in an unactuated or actuated keyswitch state, apparatus for creating an orchestra chorus wherein each assigned tone generator produces a designated audible musical tone color according to a tone priority logic that assigns a different tone color to each assigned tone generator comprising:

a plurality of waveshape generators each of which creates a musical waveshape and wherein said waveshape generators are designated by a generator index number j=1,2, . . . , M where M is the total number of the plurality of waveshape generators, a note detection means for detecting the keyswitch states of keyswitches in said keyboard array of switches and wherein a new note signal is generated corresponding to each keyswitch whose keyswitch state changes from an unactuated to an actuated keyswitch state, a plurality of tone generators each of which converts a musical waveshape created by said plurality of waveshape generators to an audible musical tone color, and an assignor means responsive to said new note signal whereby each of said musical waveshapes created by said plurality of waveshape generators are transferred to said plurality of tone generators according to a tone priority logic thereby producing said orchestra chorus musical effest.

2. A musical instrument according to claim 1 wherein said note detection means comprises:

a frequency number generator responsive to said new note signal wherein a frequency number is generated corresponding to each keyswitch in an actuated state, a plurality of frequency number memories for storing said frequency numbers, and frequency addressing means for addressing out frequency numbers from said plurality of frequency number memories and for transferring the addressed frequency numbers to a tone generator in said plurality of tone generators which correspond to a preassigned frequency number memory.

3. A musical instrument according to claim 2 wherein said assignor means comprises:

tone priority logic means whereby each musical waveshape created by said plurality of waveshape generators is transferred to one of said plurality of tone generators in a priority order responsive to the relative magnitudes of the frequency numbers stored in said plurality of frequency number memories.

4. A musical instrument according to claim 3 wherein said tone priority logic means comprises:

priority circuitry whereby said transfer of musical waveshapes is ordered in an arrangement responsive to the magnitude of the frequency numbers stored in said plurality of frequency number memories such that the musical waveshape created by the waveshape generator designated by the smallest value of said generator index j is transferred to the tone generator corresponding to the largest magnitude of said stored frequency numbers and such that the musical waveshape created by the waveshape generator designated by the largest value of said generator index j is transferred to the tone generator corresponding to the smallest magnitude of said stored frequency numbers.

5. In a musical instrument having a keyboard comprising an array of keyswitches, each keyswitch being operable in either an actuated or nonactuated keyswitch state, a multiplicity of tone generators which are assigned to actuated keyswitches contained in a keyboard array of keyswitches, apparatus for creating an orchestra chorus musical effect wherein each assigned tone generator produces a designated audible musical tone color according to a tone priority logic that assigns a different tone color to each assigned tone generator comprising:

a plurality of tone switches operable in either an actuated or released keyswitch state each of which selects a musical tone from a set of musical tones, a plurality of waveshape generators each of which generates a musical waveshape in response to each said plurality of tone switches operated in an actuated keyswitch state, a note detection means for repetitively scanning said array of keyswitches whereby a new note signal is generated corresponding to each keyswitch in said array of keyswitches whose keyswitch status changes from a nonactuated to an actuated keyswitch state, a frequency number generation means whereby a frequency number is generated in response to said new note signal, a plurality of frequency number memories for storing each said frequency number generated by said frequency number generation means, a plurality of tone generators each of which converts a musical waveshape generated by said plurality of waveshape generators into an audible musical tone color at a frequency corresponding to a frequency number stored in a corresponding one of said plurality of frequency number memories, and an assignor means having a tone priority logic responsive to frequency numbers stored in said plurality of frequency number memories whereby musical waveshapes generated by said plurality of waveshape generators is furnished to one of said plurality of tone generators thereby creating said orchestra chorus musical effect.

6. A musical instrument according to claim 5 wherein said frequency number generation means comprises:

a frequency number memory storing a table of frequency numbers, and memory addressing means for reading out a frequency number from said frequency number memory at an address corresponding to a keyswitch in said keyswitch array operated in an acuated keyswitch state.

7. A musical instrument according to claim 5 wherein said assignor means comprises;

a multiplicity of comparator means responsive to frequency numbers stored in said plurality of frequency number memories wherein all distinct pairs of stored frequency numbers are compared in magnitude and whereby a multiplicity of comparison signals are generated, and assignment selection means responsive to said multiplicity of comparison signals whereby said musical waveshapes generated by said plurality of waveshape generators are transferred to said plurality of tone generators.

8. A musical instrument according to claim 7 wherein said multiplicity of comparator means comprises:

a multiplicity of comparator signal generation means each responsive to a first frequency number and a second frequency number read out from said plurality of frequency number memories whereby a comparison signal is generated if said first frequency number is greater in magnitude than said second frequency number.

9. A musical instrument according to claim 8 wherein said assignment selection means comprises:

tone priority logic means responsive to said multiplicity of comparison signals whereby a multiplicity of select signals are generated each of which corresponds to an actuated keyswitch in said array of keyswitches and wherein said multiplicity of select signals are arranged in a priority order corresponding to the magnitude of the frequency numbers associated with said actuated keyswitches, and waveshape selection means responsive to said multiplicity of select signals whereby the musical waveshapes created by said plurality of waveshape generators are selected in said priority order and transferred to said multiplicity of tone generators in response to said new note signal.

10. In a musical instrument having a multiplicity of tone generators which are assigned to actuated keyswitches contained in a keyboard array of keyswitches, having keyswitches each of which is operable in either an actuated or a nonactuated state apparatus for producing an orchestra chorus musical effect wherein each assigned tone generator produces a designated musical tone according to a priority logic that assigns a different tone color to each assigned tone generator and wherein a selected subset of the assigned tone generators produce audible musical tones having a vibrato effect comprising:

a plurality of waveshape generators each of which independently creates a musical waveshape and wherein said waveshape generators are designated by a generator index number $j=1,2,\ldots,M$ where M is the total number of the plurality of waveshape generators, a note detection means for detecting the keyswitch states of keyswitches in said keyboard array of keyswitches and wherein a new note signal is generated corresponding to each keyswitch whose keyswitch state changes from an unactuated to an actuated keyswitch state, a frequency number generator means whereby a frequency number is generated in response to said new note signal, a plurality of frequency number memories for storing each said frequency number generated by said frequency number generation means a plurality of vibrato switches, plurality of tone generators each of which converts a musical waveshape generated by said plurality of waveshape generators into an audible musical tone color at a frequency corresponding to a frequency number stored in a corresponding one of said plurality of frequency memories and wherein each tone generator has a vibrato frequency modulator responsive to the actuation of a corresponding vibrato switch in said plurality of vibrato switches, and assignor means having a tone priority logic responsive to frequency numbers stored in said plurality of frequency number memories whereby each musical waveshape generated by said plurality of tone generators is transferred to one of said plurality of tone generators thereby creating said orchestra chorus musical effect wherein a selected subset of the assigned tone generators produce said audible musical tones having a vibrato effect.

11. In a musical instrument according to claim 10 wherein said assignor means comprises:

tone priority circuitry whereby said transfer of each musical waveshape from said plurality of waveshape generators to said plurality of tone generators is ordered in an arrangement responsive to the magnitude of the frequency numbers stored in said plurality of frequency number memories such that the musical waveshape created by the waveshape generator designated by the smallest value of said generator index j is transferred to the tone generator corresponding to the largest magnitude of said stored frequency numbers and such that the musical waveshape created by the waveshape generator designated by the largest value of said generator index j is transferred to the tone generator corresponding to the smallest magnitude of said stored frequency numbers.

* * * * *